US011421530B2

(12) United States Patent
Torgerson et al.

(10) Patent No.: US 11,421,530 B2
(45) Date of Patent: Aug. 23, 2022

(54) FOCUS PROBE FOR UNCONSOLIDATED FORMATIONS

(71) Applicant: Schlumberger Technology Corporation, Sugar Land, TX (US)

(72) Inventors: Stephen Torgerson, Sugar Land, TX (US); Hadrien Dumont, Paris (FR); Francois Robert, The Woodlands, TX (US); Christopher Babin, Waveland, MS (US); Peter Miller, Houston, TX (US); Tudor Ioan Palaghita, Houston, TX (US); Sebastian Mastrangelo, Villahermosa (MX); Gabriel Morosini, Bergen (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/613,817

(22) PCT Filed: May 17, 2018

(86) PCT No.: PCT/US2018/033082
§ 371 (c)(1),
(2) Date: Nov. 15, 2019

(87) PCT Pub. No.: WO2018/213523
PCT Pub. Date: Nov. 22, 2018

(65) Prior Publication Data

US 2020/0173276 A1 Jun. 4, 2020

Related U.S. Application Data

(60) Provisional application No. 62/507,774, filed on May 17, 2017.

(51) Int. Cl.
*E21B 49/10* (2006.01)
*E21B 49/08* (2006.01)
(Continued)

(52) U.S. Cl.
CPC ..... *E21B 49/10* (2013.01); *E21B 49/081* (2013.01); *E21B 47/06* (2013.01); *E21B 47/26* (2020.05);
(Continued)

(58) Field of Classification Search
CPC ..... E21B 49/10; E21B 49/081
See application file for complete search history.

(56) References Cited

U.S. PATENT DOCUMENTS 3,934,468 A 1/1976 Brieger
4,416,152 A 11/1983 Wilson
(Continued)

FOREIGN PATENT DOCUMENTS

GB 2444134 A 5/2008

OTHER PUBLICATIONS

International Search report and Written Opinion issued in corresponding PCT Application PCT/US2018/033082, dated Aug. 9, 2018 (12 pages).
(Continued)

*Primary Examiner* — Shane Bomar
(74) *Attorney, Agent, or Firm* — Trevor G. Grove

(57) ABSTRACT

A fluid sampling probe may include one or more features that increase the likelihood that a seal will be maintained during a sampling operation, even for sampling operations in unconsolidated formations. This may reduce contamination in formation fluid samples that are obtained during sampling operations. The fluid sampling probe may include a reinforcement ring configured to extend into a geological formation beyond an elastomer portion of the fluid sampling
(Continued)

probe, which may support the geological formation and prevent a failure of the formation during sampling operations. The fluid sampling probe may also include a stop sleeve to prevent overextension that could otherwise cause the geological formation to collapse. In addition, the fluid sampling probe may include a relatively wider sealing elastomer that may decrease in height monotonically radially from the center of the fluid sampling probe.

20 Claims, 6 Drawing Sheets

(51) Int. Cl.
*E21B 47/26* (2012.01)
*E21B 47/06* (2012.01)

(52) U.S. Cl.
CPC ..... *E21B 49/088* (2013.01); *E21B 49/0875* (2020.05)

(56) References Cited

U.S. PATENT DOCUMENTS 4,807,707 A 2/1989 Handley et al.
7,690,423 B2 * 4/2010 Del Campo ..... E21B 31/00 166/100
8,499,831 B2 * 8/2013 Church ..... E21B 49/10 166/264
8,899,323 B2 * 12/2014 Zazovsky ..... E21B 49/10 166/264
9,057,250 B2 * 6/2015 Zazovsky ..... E21B 49/08
9,085,964 B2 * 7/2015 Sherrill ..... E21B 49/10
2006/0076132 A1 * 4/2006 Nold, III ..... E21B 49/10 166/264
2006/0117842 A1 * 6/2006 Ramakrishnan ..... E21B 49/10 73/152.55
2008/0156487 A1 * 7/2008 Zazovsky ..... E21B 47/01 166/264
2012/0160514 A1 6/2012 Wade et al.
2015/0068736 A1 3/2015 Dirksen et al.
2017/0089196 A1 * 3/2017 Corre ..... E21B 49/10

OTHER PUBLICATIONS

International Preliminary Report on Patentability issued in corresponding PCT Application PCT/US2018/033082, dated Nov. 28, 2019 (11 pages).

* cited by examiner

FOCUS PROBE FOR UNCONSOLIDATED FORMATIONS

CROSS-REFERENCE TO RELATED APPLICATIONS

The present application claims the benefit of and priority to U.S. Provisional Application No. 62/507,774, entitled "Focus Probe for Unconsolidated Formations" and filed May 17, 2017, the disclosure of which is incorporated herein by reference in its entirety for all purposes.

BACKGROUND

This disclosure relates to reducing contamination in downhole fluid samples using a focus probe system for unconsolidated downhole formations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Reservoir fluid analysis may be used in a wellbore in a geological formation to locate hydrocarbon-producing regions in the geological formation, as well as to manage production of the hydrocarbons in these regions. A downhole acquisition tool may carry out reservoir fluid analysis by drawing in formation fluid and testing the formation fluid downhole, or by collecting a sample of the formation fluid to bring to the surface. Although native reservoir fluid (e.g., oil, gas, or water) from a hydrocarbon reservoir in the geological formation may be the fluid of interest for reservoir fluid analysis, fluids other than the native reservoir fluid may contaminate the native reservoir fluid. As such, the formation fluid obtained by the downhole acquisition tool may contain extraneous materials other than pure native reservoir fluid. Drilling muds, for example, may be used in drilling operations and may invade the formation and mix with the native reservoir fluid. The formation fluid drawn from the wellbore, thus, may be contaminated with drilling fluid.

Currently, focus probes are used to reduce contamination of formation fluid drawn from a wellbore. Focus probes operate by pressing at least an outer probe and an inner probe against a wall of the wellbore. Generally, the outer probe forms a seal around the inner probe to prevent drilling mud fluid from contaminating the sample area. However, in unconsolidated formations, the outer or inner probes may fail to form a seal for the duration of sampling. This may allow drilling fluid to flow into the sample area and contaminate the sample.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a probe module system for sampling fluid from a geological formation includes a guard probe having an elastomer portion and a reinforcement ring. The reinforcement ring is at least partially disposed within an elastomer borehole of the elastomer portion. The reinforcement ring extends beyond the elastomer portion. Additionally, the elastomer portion is configured to press against the geological formation to form a seal during a sampling operation to support the geological formation during the sampling operation. The probe module system also includes a sampling probe disposed within a borehole of the guard probe. The sampling probe is configured to press against the geological formation. Also, the sampling probe is configured to perform the sampling operation by collecting fluid from the geological formation at an interface between a free end of the sampling probe and the geological formation.

In accordance with another embodiment, downhole fluid sampling system includes a downhole tool. Moreover, the downhole fluid sampling system includes a probe module configured to draw sample fluid from a geological formation. The probe module includes a guard probe having an elastomer portion and a reinforcement ring coupled to a movable probe base. The reinforcement ring is at least partially disposed within an elastomer borehole of the elastomer portion. The reinforcement ring extends beyond the elastomer portion. Additionally, the elastomer portion is configured to press against the geological formation to form a seal during a sampling operation to support the geological formation during the sampling operation. The probe module also includes a sampling probe disposed within a borehole of the guard probe. The sampling probe is configured to press against the geological formation. Also, the sampling probe is configured to perform the sampling operation by collecting formation fluid from the geological formation at an interface between a free end of the sampling probe and the geological formation. Further, the downhole fluid sampling system includes a fluid sampling module coupled to the downhole tool and configured to evaluate fluid properties of the formation fluid from the geological formation.

In accordance with another embodiment, a method for collecting downhole fluid samples includes positioning a probe module at a sampling site for a sampling operation. The probe module includes a guard probe having an elastomer portion and a reinforcement ring coupled to a movable probe base of the probe module. The reinforcement ring is at least partially disposed within an elastomer borehole of the elastomer portion, and the reinforcement ring extends beyond the elastomer portion. The probe module also includes a sampling probe disposed within a borehole of the guard probe. The method further includes extending the movable probe base toward a geological formation such that the guard probe presses against the geological formation such that reinforcement ring breaches the geological formation and extends into the geological formation to support the geological formation during the sampling operation. Additionally, the elastomer portion is configured to press against a surface of the geological formation to form a seal between the geological formation and the guard probe. The method also includes extending the sampling probe, with respect to the reinforcement ring, such that the sampling probe presses into the geological formation and collecting fluid from the geological formation at an interface between a free end of the sampling probe and the geological formation.

BRIEF DESCRIPTION OF THE DRAWINGS

Various aspects of this disclosure may be better understood upon reading the following detailed description and upon reference to the drawings in which.

DETAILED DESCRIPTION

Figure 1:
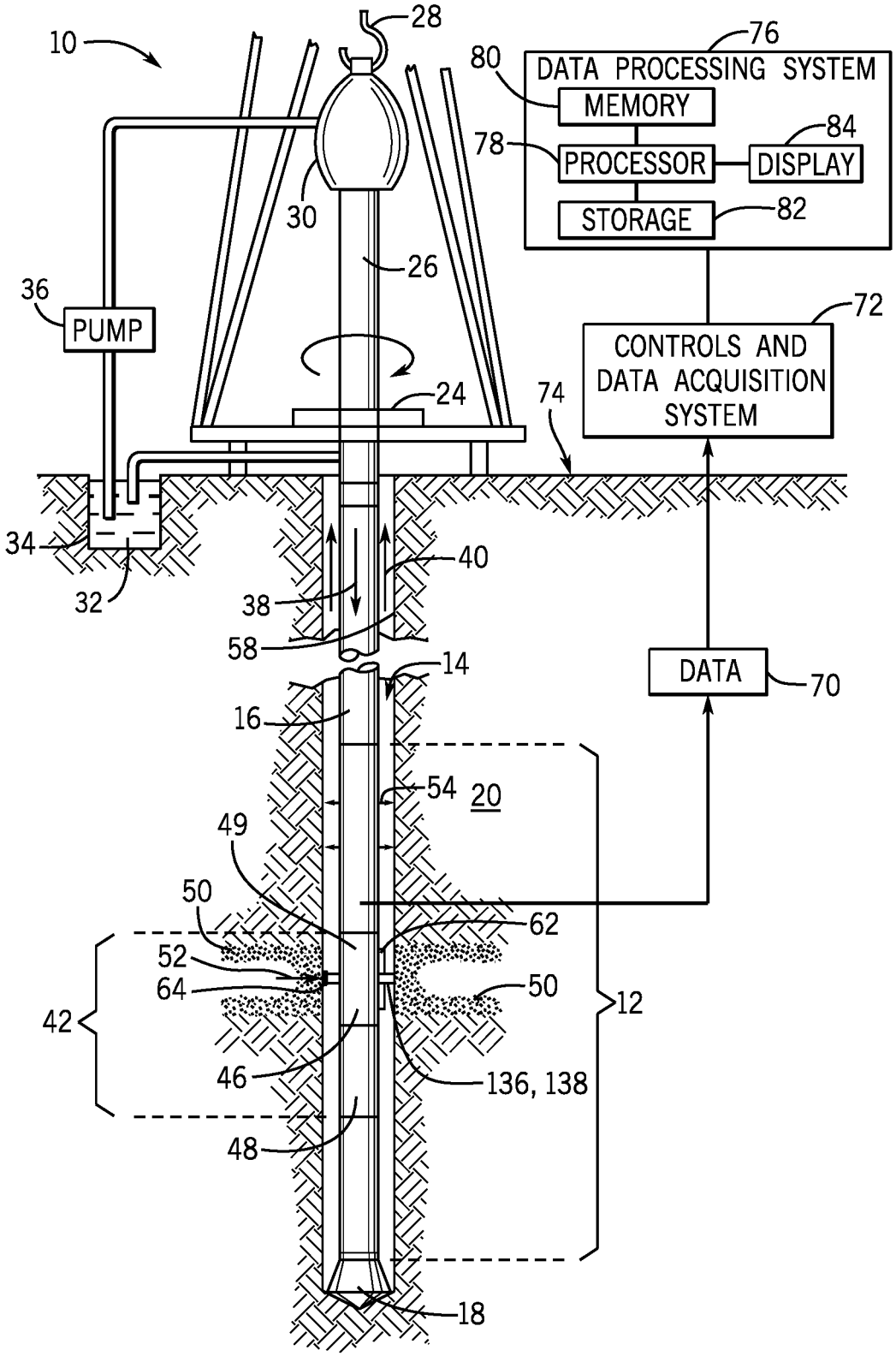
FIG. 1 is a schematic diagram of a wellsite system that may employ downhole fluid analysis methods for determining contamination in a formation fluid, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Acquisition and analysis of representative formation fluid samples downhole is useful for determining the economic value of hydrocarbon reserves and oil field development. However, formation fluid samples may be contaminated with drilling fluids that invade the geological formation during and/or after drilling operations. If contamination occurs, it may be difficult to assess a composition of the geological formation fluid (also referred to as "native formation fluid"), and to determine the economic value of the hydrocarbon reserves. Some downhole acquisition tools may include multiple probes that flow the formation fluid through the tool for analysis. For example, in focused sampling applications, a downhole acquisition tool may include a sampling probe and a guard probe. A multi-probe configuration of the downhole acquisition tool may facilitate separation of contaminants (e.g., drilling fluid, mud filter cake) from the native formation fluid, and allow collection of a representative sample of the native formation fluid (e.g., uncontaminated formation fluid) for analysis in a faster amount of time as compared to single probe downhole acquisition tools. In operation, packers formed around the guard probe and the sampling probe may press against the wall of the wellbore to form a seal against the wellbore wall. The seal is meant to prevent other fluids in the wellbore from entering the guard probe or the sampling probe during sampling. However, the seal may not prevent contamination of the geological formation fluid in the event of a wash-out (e.g., structural failure of the geological formation at the seal). For example, when collecting geological formation fluid from an unconsolidated geological formation, drilling fluids (e.g., drilling mud) may degrade the unconsolidated formation at the seal, which may break the seal.

The systems and methods of this disclosure may be used to improve the likelihood that the seal will be maintained between the guard probe and the wellbore wall and/or between the sampling probe and the wellbore wall, even in unconsolidated formations. This may reduce contamination in the fluid samples that are obtained.

Figure 2:
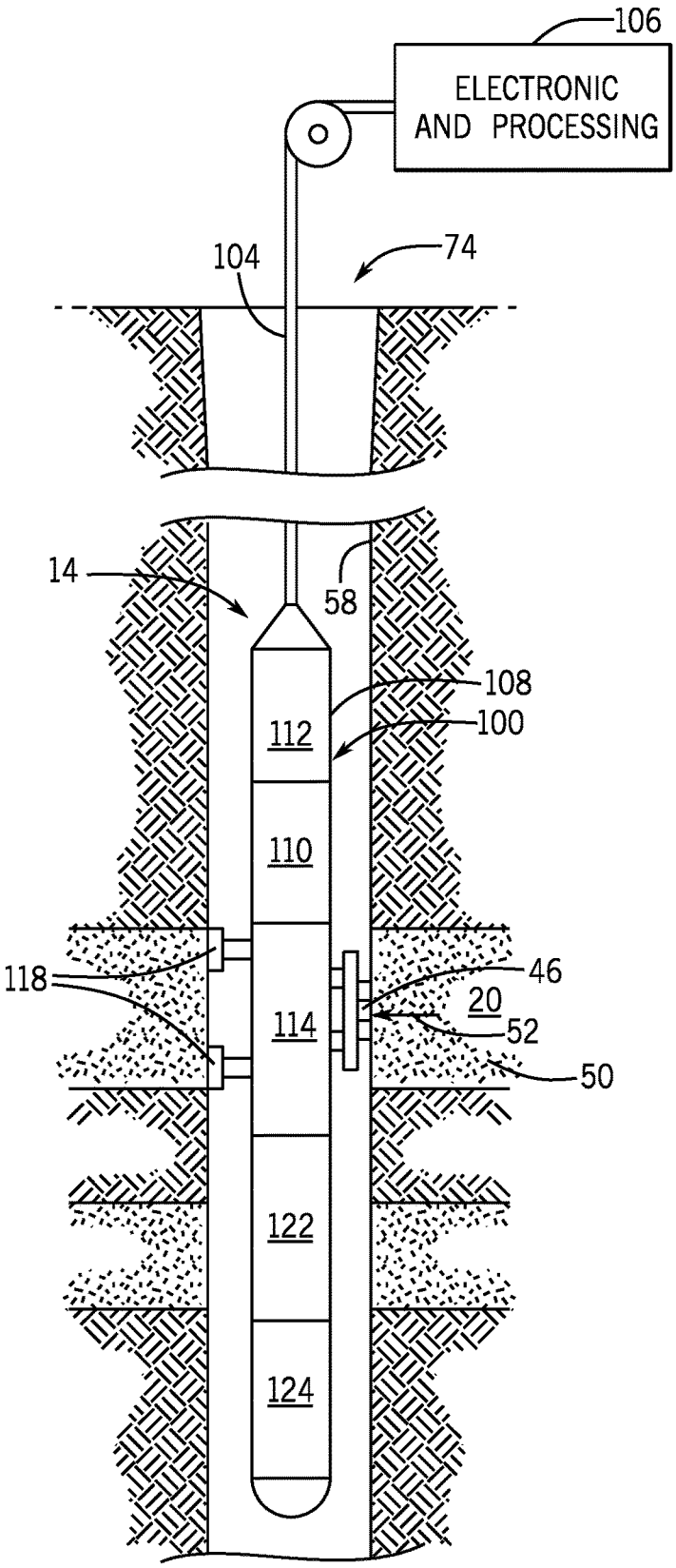
FIG. 2 is a schematic diagram of another embodiment of a wellsite system that may employ downhole fluid analysis methods for determining contamination in a formation fluid, in accordance with an embodiment.

FIGS. 1 and 2 depict examples of wellsite systems that may employ the fluid analysis systems and techniques described herein. For example, FIG. 1 depicts a rig 10 with a downhole acquisition tool 12 coupled to a drill string 16. The downhole acquisition tool 12 is suspended into a wellbore 14 via the drill string 16. The drill string 16 has a drill bit 18 at its lower end that is used to advance the drill string 16 into a geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., oil-based mud (OBM) or water-based mud (WBM)) is stored in a pit 34 formed at the well site. A pump 36 delivers the drilling fluid 32 to the interior of the drill string 16 via a port in the swivel 30, inducing the drilling mud 32 to flow downwardly through the drill string 16 as indicated by a directional arrow 38. The drilling fluid 32 exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12 may be positioned near the drill bit 18, and includes various components with capabilities, such as measuring, processing, and storing information, as well as communicating with the surface. A telemetry device (not shown) also may be provided for communicating with a surface unit (not shown). In certain embodiments, the downhole acquisition tool 12 may be conveyed on wired drill pipe, a combination of wired drill pipe and wireline, or other suitable types of conveyance.

The downhole acquisition tool 12 further includes a downhole fluid sampling system 42 including a probe module 46, a fluid sampling module 48, and a sample bottle module 56. In certain embodiments, the modules 46, 48, 56 may be housed in a drill collar for performing various formation evaluation functions, such as pressure testing and fluid sampling, among others, and collecting representative samples of native formation fluid 50. As shown in FIG. 1, in certain embodiments, the probe module 46 may be positioned adjacent the fluid sampling module 48; however, the position of the probe module 46, as well as other modules 48, 56, may vary in other embodiments. Additional devices, such as pumps, gauges, sensors, monitors, or other devices usable in downhole sampling and/or testing also may be provided. The additional devices may be incorporated into one or more of the modules 46, 48, 56, or may be disposed within separate modules included within the downhole fluid sampling system 42.

In certain embodiments, the probe module 46 may include a movable probe base 62 coupled to the drill string 16. In certain embodiments, the probe module 46 includes one or more inlets for receiving a formation fluid 52 and one or more flow lines (not shown) extending into the downhole acquisition tool 12 for passing fluids (e.g., the formation fluid 52) through the downhole acquisition tool 12. In certain embodiments, the probe module 46 may include a single inlet (e.g., single probe configuration) designed to direct the formation fluid 52 into a flowline within the downhole acquisition tool 12. In other embodiments, the probe module 46 may include multiple inlets (e.g., a sampling probe 136 and a guard probe 138) that may, for example, be used for focused sampling. In these embodiments, the probe module 46 may be connected to a sampling flow line 180, as well as to a guard flow line.

Furthermore, in certain embodiments, the guard probe 138 and the sampling probe 136 may be movable between extended and retracted positions for selectively engaging the wellbore wall 58 of the wellbore 14 and acquiring fluid samples from the geological formation 20. In certain embodiments, the sampling probe 136 may be independently movable with respect to the guard probe 138. Engaging the wellbore wall 58 with the sampling probe 136 and/or the guard probe 138 may cause the probe module 46 to move. Thus, in certain embodiments, one or more setting pistons 64 may be provided to support the probe module 46 by assisting in positioning the probe module 46 or in maintaining a position of the probe module 46. Specifically, the one or more setting pistons 64 may be configured to extend into the geological formation 20 on a side of the downhole acquisition tool 12 opposite the sampling probe 136 and/or the guard probe 138 of the probe module 46. Thus, the one or more setting pistons 64 may be configured to counteract any resultant forces from the sampling probe 136 and/or the guard probe 138 of the probe module 46.

In certain embodiments, the downhole acquisition tool 12 may evaluate fluid properties of the drilling mud 32, the native formation fluid 50, or a formation fluid 52, which may be a mixture of the drilling mud 32 and the native formation fluid 50. Accordingly, in certain embodiments, the downhole fluid sampling system 42 may include sensors that may measure fluid properties such as gas-to-oil ratio (GOR); mass density; optical density (OD); composition of carbon dioxide ($CO_2$), $C_1$, $C_2$, $C_3$, $C_4$, $C_5$, and/or $C_{6+}$; formation volume factor; viscosity; resistivity; conductivity, fluorescence; compressibility, and/or combinations of these properties of the drilling mud 32, the native formation fluid 50 (e.g., native formation water or hydrocarbons), and/or the formation fluid 52. For example, during drilling, the drilling mud 32 may degrade the wellbore wall 58 (e.g., surface of the geological formation 20), as illustrated by arrow 54, thereby breaking the seal formed by engaging the probe module 46, and possibly contaminating the native formation fluid 50 with the drilling mud 32.

The sensors within the downhole fluid sampling system 42 may collect and transmit data 70 associated with the fluid properties and the composition of the formation fluid 52 to a control and data acquisition system 72 at the surface 74, where the data 70 may be stored and processed in a data processing system 76 of the control and data acquisition system 72. The data processing system 76 may include a processor 78, memory 80, storage 82, and/or display 84. The memory 80 may include one or more tangible, non-transitory, machine readable media collectively storing one or more sets of instructions for operating the downhole acquisition tool 16. To process the data 70, the processor 78 may execute instructions stored in the memory 80 and/or the storage 82. As such, the memory 80 and/or the storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 16. It should be appreciated that, although the data processing system 76 is shown by way of example as being located at the surface 74, in other embodiments, the data processing system 76 may be located wholly or partly in the downhole acquisition tool 16. In such embodiments, some of the data 70 may be processed and stored downhole (e.g., within the wellbore 14), while some of the data 70 may be sent to the surface 74 (e.g., in real time) for processing.

FIG. 2 depicts an example of a wireline downhole tool 100 that may employ the systems and techniques of this disclosure. The wireline downhole tool 100 is suspended in the wellbore 14 from the lower end of a multi-conductor cable 104 that is spooled on a winch at the surface 74. Like the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124, that provide various functionalities including fluid sampling, sample bottle filling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a probe module 46 that has a probe module 46 and one or more setting pistons 118 that are arranged on opposite sides of the elongated body 108. The probe module 46 is configured to selectively seal off or isolate selected portions of the wall 58 of the wellbore 14 to fluidly couple to the adjacent geological formation 20 and/or to draw fluid samples from the geological formation 20. The probe module 46 may include a single inlet or multiple inlets designed for guarded or focused sampling. The native formation fluid 50 may be expelled to the wellbore through a port in the elongated body 108 or the formation fluid 52, including the native formation fluid 50, may be sent to one or more fluid sampling modules 48. The one or more fluid sampling modules 48 may include sample chambers that store the formation fluid 52. In the illustrated embodiment, the electronics and processing system 106 and/or a downhole control system may control the probe module 46 and/or the drawing of a fluid sample from the geological formation 20.

Figure 3:
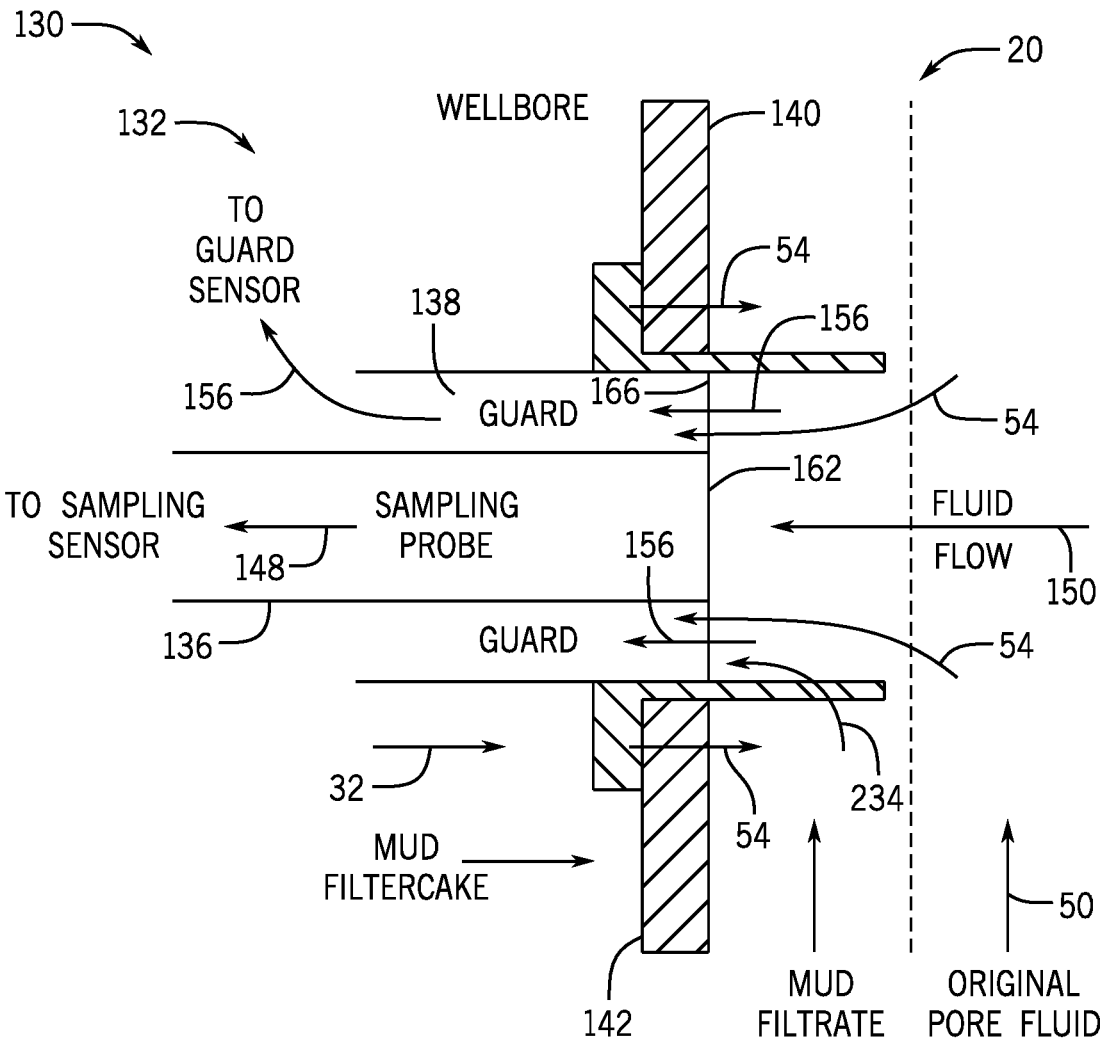
FIG. 3 depicts a geometrical model of a focused sampling tool, in accordance with one or more embodiments of the present disclosure.

FIG. 3 illustrates an embodiment of a geometrical model 130 of the downhole acquisition tool 12 that uses focused sampling for downhole fluid analysis applications. In the model 130, the downhole acquisition tool 12 includes a probe module 46 that includes a sampling probe 136 and a guard probe 138 surrounding the sampling probe 136. As discussed above, the drilling fluid 54 (e.g., oil-based mud filtrate or water-based mud filtrate) may degrade the geological formation 20, thereby contaminating the native formation fluid 50. For example, in the illustrated embodiment, drilling mud 32 degrades and/or penetrates a surface 140 of the geological formation 20. A portion of the drilling mud 32 (e.g., suspended solids) may form a mud filter cake 142 against the surface 140 of the geological formation 20 as the drilling fluid 54 flows through the surface 140 of the geological formation 20. The drilling fluid 54 may mix with native formation fluid 50 (e.g., uncontaminated formation fluid) within the geological formation 20 (e.g., rock, sand, or other materials), thereby contaminating the native formation fluid 50.

The guard probe 138 may separate a portion of the drilling fluid 54 from the native formation fluid 50 during sampling. For example, as illustrated in FIG. 3, a first fraction 148 of a total flow of formation fluid 150 (e.g., the mud filter cake 142, the drilling fluid 54, and the native formation fluid 50) enters a sampling probe intake 162 of the sampling probe 136, and a second fraction 156 of the total formation fluid 150 enters a guard probe intake 166 of the guard probe 138. The guard probe 138 may be pressed against the wellbore wall 58 (e.g., the surface 140 of the geological formation) of the wellbore 14 in a way that forms a seal to prevent other wellbore fluids from being drawn in.

Figure 4:
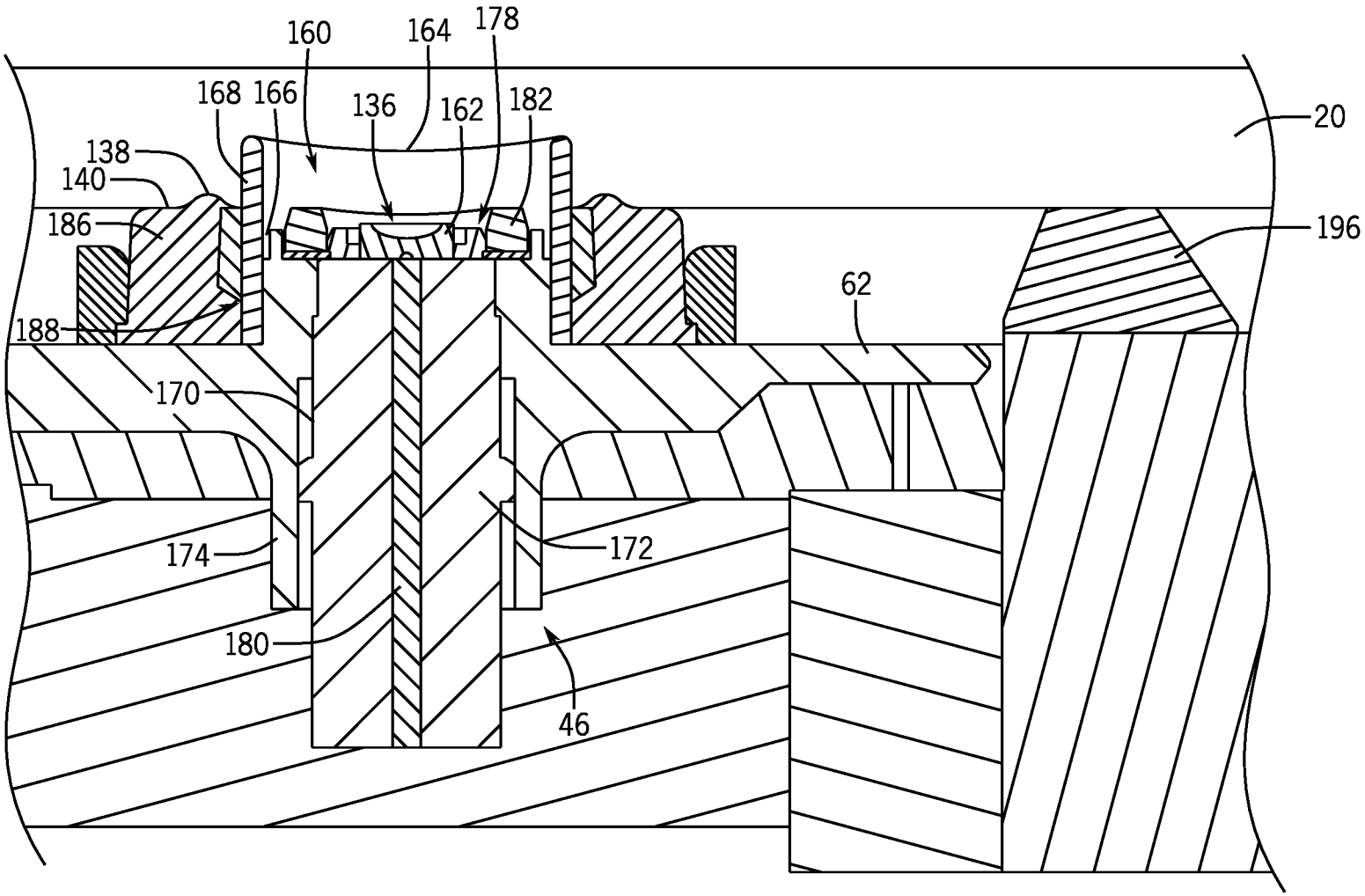
FIG. 4 is a schematic diagram of an embodiment of a multi-intake probe for an unconsolidated formation.

FIG. 4 is a schematic diagram of an embodiment of a probe module 46 for sampling a formation fluid from a geological formation 20 (e.g., an unconsolidated formation). In the illustrated embodiment, the probe module 46 is a multi-intake probe module that includes a guard probe 138 and a sampling probe 136 disposed within a borehole 160 of the guard probe 138. The sampling probe 136 is configured to perform a sampling operation by collecting formation fluid from the geological formation 20 at the sampling probe intake 162 disposed at a free end 164 of the sampling probe 136. In certain embodiments, the guard probe 138 is also configured to perform a sampling operating by collecting formation fluid from the geological formation 20 at a guard probe intake 166. In certain embodiments, the guard probe intake 166 may be formed between a reinforcement ring 168 of the guard probe 138 and an outer surface 170 of the sampling probe 136. In certain embodiments, the reinforcement ring 168 and the sampling probe 136 are coaxial.

The sampling probe 136 may include a hollow piston body 172 configured to actuate within a cylinder 174 of a movable probe base 62 with respect to the guard probe 138. An outer piston surface 170 of the hollow piston body 172 may form the outer surface of the sampling probe 136. Moreover, the sampling probe 136 may include a sampling probe head 178 configured to press into the geological formation 20 during the sampling operation. The sampling probe intake 162 may be disposed in the sampling probe head 178. The sampling flow line 180 extends from the sampling probe head 178 at the sampling probe intake 162, through the hollow piston body 172 to the fluid sampling module or the sample bottle module. Formation fluid from the sampling operation passes through the sampling flow line 180.

In certain embodiments, the sampling probe head 178 includes a packer 182 configured to form a seal between the sampling probe head 178 and the geological formation 20. The packer 182 may be disposed around the sampling probe intake 162 such the seal is formed around the sampling probe intake 162, which may reduce contaminants (e.g., drilling fluid) from entering the formation fluid during the sampling operation. In certain embodiments, the packer 182 may be coupled to a portion of the hollow piston body 172. The sampling probe intake 162 may be configured to actuate, via a piston assembly, with respect to the packer 182.

In certain embodiments, the guard probe 138 comprises an elastomer portion 186 (e.g., elastomer packer) and a reinforcement ring 168. The elastomer portion 186 and the reinforcement ring 168 may be coupled to the movable probe base 62. Similar to the packer 182 of the sampling probe 136 discussed above, the elastomer portion 186 is configured to form a seal between the guard probe 138 and the geological formation 20 during sampling operations. Specifically the elastomer portion 186 is configured to form a seal between the guard probe 138 and a surface 140 of the geological formation 20. In certain embodiments, the elastomer portion 186 includes an elastomer borehole 188. In the illustrated embodiment, the reinforcement ring 168 is at least partially disposed within the elastomer borehole 188. In certain embodiments, the reinforcement ring 168 may extend beyond the elastomer portion 186 in a direction radially outward with respect to the movable probe base 62. For example, in certain embodiments, the reinforcement ring 168 may be configured to extend beyond the elastomer portion 186 by 0.25 to 0.55 inches. However, as discussed below, in other embodiments, the reinforcement ring 168 may be configured to extend more or less than 0.25 to 0.55 inches beyond the elastomer portion 186.

In certain embodiments, the reinforcement ring 168 is configured to assist in forming a seal between the guard probe 138 and the geological formation 20. In the illustrated embodiment, the reinforcement ring 168 is configured to assist in forming the seal by supporting the unconsolidated geological formation 20 during the sampling operation. Unconsolidated geological formations are generally softer and more prone to degradation and wash-out than other geological formations. As discussed above, drilling fluid (e.g., drilling mud) 32 passing through the wellbore 14 may degrade the wellbore wall 58 (e.g., the geological formation 20) at a location of the sampling operation. However, the reinforcement ring 168 is configured to support the geological formation 20 to reduce degradation from the drilling fluid 32. Specifically, as the reinforcement ring 168 may extend beyond the elastomer portion 186, which forms a seal at the surface 140 of the geological formation 20, the reinforcement ring 168 is configured to breach the surface 140 of the geological formation 20 and extend into the geological formation 20. For example, the reinforcement ring 168 may be configured to extend into the geological formation 20 at least a distance that the reinforcement ring 168 extends beyond the elastomer portion 186 to support the geological formation 20 disposed around the guard probe 138.

In certain embodiments, the reinforcement ring 168 may be independently movable with respect to the elastomer portion 186. Engaging the geological formation 20 with the reinforcement ring 168 and/or the elastomer portion 186 of the guard probe 138 may comprise sliding or otherwise moving the reinforcement ring 168 with respect to the elastomer portion 186, depending on the characteristics of the geological formation 20 (e.g., unconsolidated, consolidated, or some variation there between). Therefore, in certain embodiments, when the geological formation 20 is unconsolidated, the borehole surface of the geological formation 20 is soft. The reinforcement ring 168 may be able to extend into the geological formation for a sufficient depth (e.g. 0.25 inches, 0.55 inches, or other variations) to engage the unconsolidated formation. However, in certain other embodiments, when the geological formation 20 is consolidated, the borehole surface of the geological formation 20 can be substantially hard, rendering it difficult for the reinforcement ring 168 to engage and/or penetrate the borehole surface of the geological formation. In this case, the reinforcement ring 168 may remain retracted with respect to the elastomer portion 186. That is, the reinforcement ring 168 may extend 0 inches or −0.25 inches beyond the elastomer portion 186. In such embodiments, the seal between the guard probe 138 and the geological formation 20 is formed primarily by the elastomer portion 186. In certain additional embodiments, when the geological formation 20 is partially unconsolidated, the reinforcement ring 168 may extend partially into the geological formation 20.

Positioned within a geological formation 20 that is unconsolidated, the reinforcement ring 168 may function similar to a retaining wall and prevent movement of the geological formation 20 in a direction of flow of the drilling fluid 32 (e.g., a direction parallel to an axis of the wellbore 14). Additionally, in the event that the drilling fluid 32 degrades the formation at the surface 140 of the geological formation 20, which may break the seal formed by the elastomer portion 186, a wash-out may not occur until the degradation reaches a distance into the geological formation 20 greater than a distance that the reinforcement ring 168 extends into the geological formation 20. Furthermore, the reinforcement ring 168 may provide mechanical support to the geological formation 20 disposed inside of the reinforcement ring 168 to allow the fluid sampling module 48 to collect formation fluid at higher rates than a downhole fluid sampling system without the reinforcement ring 168.

In addition to supporting the geological formation 20, the reinforcement ring 168 may also be relatively impermeable, thereby preventing drilling fluid 32 from passing through the reinforcement ring 168 and into the formation fluid being collected by the fluid sampling module 48. Further, the reinforcement ring 168 may include a material and form configured to withstand forces associated with breaching the surface 140 of the geological formation 20 and the degradation of the geological formation 20. For example, in certain embodiments, the reinforcement ring 168 may include any suitable material, such as stainless steel (e.g., 17-4PH stainless steel).

In certain embodiments, the guard probe 138 extends and retracts with respect to the downhole acquisition tool 12. For example, the guard probe 138 is configured to radially extend, via the movable probe base 62, to contact and press into the geological formation 20 during the sampling operation. Upon completion of the sampling operation, the guard probe 138 is configured to radially retract. The guard probe 138 may be configured to press against the geological formation 20 with sufficient force to form a seal between the geological formation 20 and the sampling probe 136. In certain embodiments, the probe module 46 includes a sensor configured to determine a pressure, force, or other suitable metric exerted against the geological formation 20 to determine that a seal is formed, maintained, or both, by the guard probe 138. The probe module 46 may be configured to maintain the pressure, force, or other suitable metric within a predetermined range suitable for forming and maintaining the seal between the guard probe 138 and the geological formation 20. For example, an upper limit of the predetermined range may be configured to reduce a likelihood that the guard probe 138 may cause the geological formation 20 to collapse at the location of the sampling operation, which may break the seal between the guard probe 138 and the geological formation 20. As discussed above, forming a seal with the guard probe 138 assists in preventing drilling fluid 32 and/or from contaminating formation fluid samples.

Figure 5:
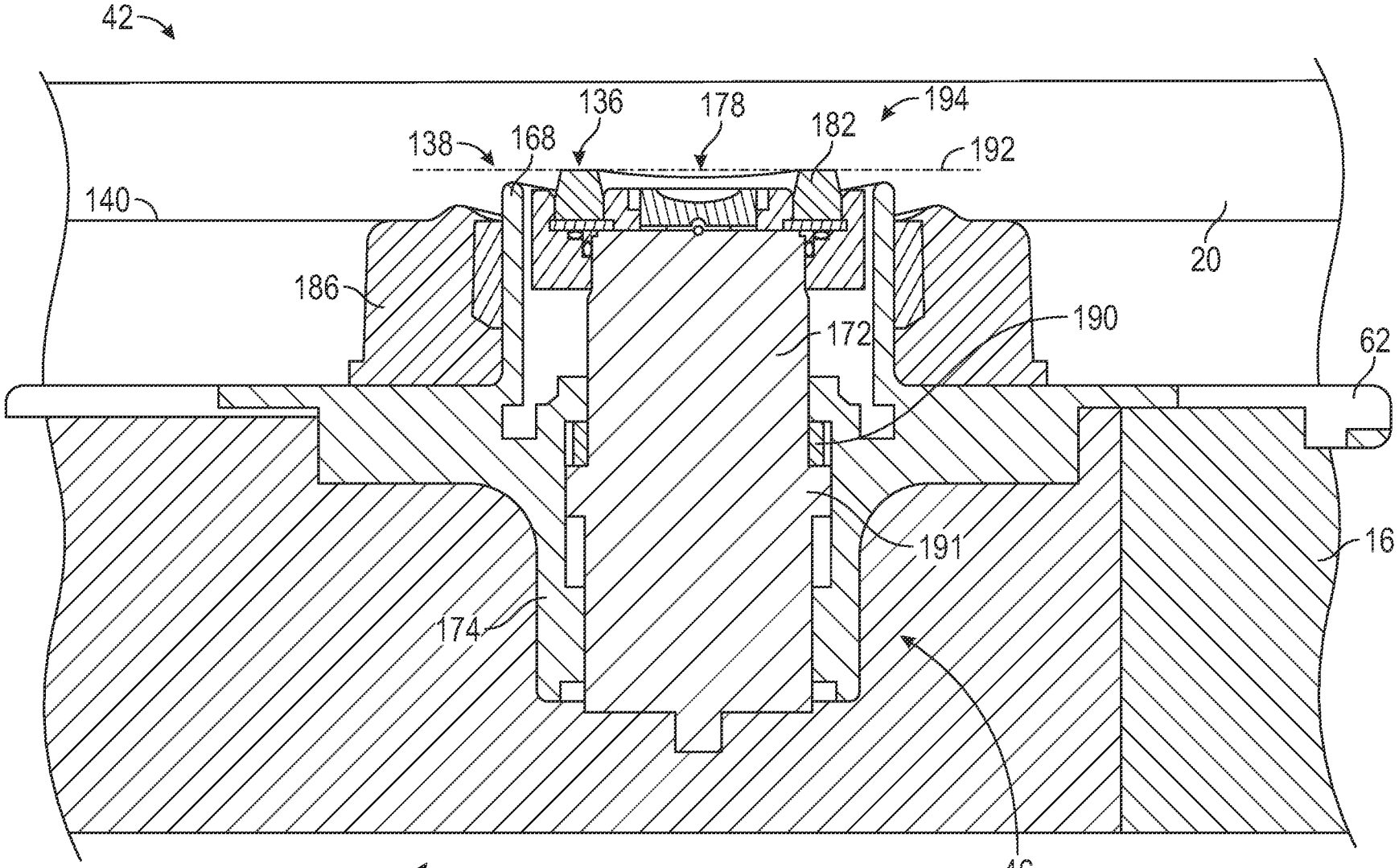
FIG. 5 is a schematic diagram of another embodiment of the multi-intake probe for an unconsolidated formation having a stop sleeve.

FIG. 5 is a schematic diagram of another embodiment of the probe module 46 for sampling a formation fluid from the geological formation 20. In the illustrated embodiment, the probe module 46 includes a stop sleeve 190, retaining ring, or similar device configured to reduce the extent to which the sampling probe 136 can extend into the geological formation 20. Unlike the situation where the sampling probe 136 is extended toward a consolidated formation, whereby the consolidated formation may limit the extent to which the sampling probe 136 may extend, when the sampling probe 136 is extended toward an unconsolidated formation, the sampling probe 136 may continue to extend into the unconsolidated formation so far that the adjacent area of the unconsolidated formation may collapse. If this occurred, the seal around the guard probe 138 may fail. Accordingly, in certain embodiments, the probe module 46 may actuate the sampling probe 136 only to an extent that enables the sampling probe 136 to press and seal against the unconsolidated formation of the wellbore wall 58, without extending so far that part of the unconsolidated formation collapses. An actuation threshold 192 may be set to define a distance that the sampling probe 136 may be permitted to radially extend. The actuation threshold 192 may be determined, for example, through computer modeling or empirical measurements through experimentation. In general, the actuation threshold 192 may be smaller, in general, than those used in consolidated formations.

In the illustrated embodiment, the probe module 46 includes a stop sleeve 190 configured to restrict actuation of the hollow piston body 172 of the sampling probe 136 proximate an end stroke of the hollow piston body 172. Since extending the sampling probe 136 too far toward the unconsolidated formation wall may damage the unconsolidated formation wall, the stop sleeve 190 may partially restrict the actuation of the sampling probe 136 such that the sampling probe 136 does not extend beyond an actuation threshold 192. In certain embodiments, the actuation threshold 192 is located at a free end of the reinforcement ring 168 (e.g., the end configured to engage the geological formation 20). Thus, in certain embodiments, the sampling probe 136 may not extend past the reinforcement ring 168 of the guard probe 138. However, in other embodiments, the actuation threshold 192 may be set for a distance proximate a free end of the elastomer portion 186 such that the sampling probe 136 may not extend past the elastomer portion 186 of the guard probe 138. In the illustrated embodiment, the actuation threshold 192 is set at a distance that extends beyond the reinforcement ring 168, such that the sampling probe 136 may extend a distance beyond the reinforcement ring 168. In certain embodiments, the stop sleeve 190 may include a ring formed from any suitable material that fits within the cylinder 174 of the movable probe base 62 and prevents the sampling probe 136 from extending beyond the actuation threshold 192. In some embodiments, the stop sleeve 190 can be disposed within the cylinder 174 of the movable probe base 62 and the stop sleeve 190 can be configured to restrict actuation of the hollow piston body 172 of the sampling probe 136 by engaging a stop 191 formed on the hollow piston body 172. It should be appreciated that any other suitable structure or technique to limit the amount that the sampling probe 136 may extend may be used. For example, the actuator that drives the movement of the sampling probe 136 may receive control signals that do not fully extend the sampling probe 136. Additionally or alternatively, another obstructive element than the stop sleeve 190 may be disposed in the path of the extensive components of the sampling probe 136 to prevent the sampling probe 136 from reaching beyond the actuation threshold 192.

In operation, the downhole fluid sampling system 42 is configured to position the probe module 46 at a sampling site 194 (e.g., location for the sampling operation). The downhole fluid sampling system 42 may position the probe module 46, via movement of the drill string 16, to which the probe module 46 is coupled. However, in other embodiments, the downhole fluid sampling system 42 may position the probe module 46 independent of movement of the drill string 16. For example, the system may use the wireline downhole tool 100 to position the probe module 46. Once the probe module 46 is in position, the probe module 46 may radially extend the movable probe base 62 in a direction toward the geological formation 20 at the sampling site 194 until the guard probe 138 presses into the geological formation 20 (e.g., unconsolidated formation). Specifically, in certain embodiments, the movable probe base 62 may radially extend until the reinforcement ring 168 breaches the surface 140 of the geological formation 20 and extends into the geological formation 20 to support the geological formation 20. Furthermore, in certain embodiments, the movable probe base 62 may radially extend until the elastomer portion 186 presses against the surface of the geological formation 20 with sufficient force to form a seal between the elastomer portion 186 and the geological formation 20. Once the guard probe 138 is sufficiently extended, the probe module 46 may be configured to extend the sampling probe 136 such that the sampling probe head 178 presses into the geological formation 20. The sampling probe 136 may be configured to extend into the geological formation 20 with sufficient force such that the packer 182 forms a seal between the sampling probe 136 and the geological formation 20. In certain embodiments, the guard probe 138 and the sampling probe 136 may be configured to radially extend simultaneously. Once the guard probe 138 and the sampling probe 136 are sufficiently extended, the sampling probe 136 is configured to collect formation fluid via the sampling probe intake 162. In certain embodiments, the guard probe 138 is configured to collect formation fluid via the guard probe intake 166.

Upon completion of the sampling operation at the sampling site 194, the probe module 46 may be configured to disengage from the geological formation 20 such that the probe module 46 may re-position to another location for a second sampling operation. For example, in certain embodiments, the probe module 46 may be configured to first retract the sampling probe 136, determine the sampling probe 136 is retracted into the borehole 160 of the guard probe 138, and then retract the movable probe base 62 to disengage the guard probe 138 from the geological formation 20. Retracting the movable probe base 62 may effectively retract the guard probe 138.

In the illustrated embodiment, the reinforcement ring 168 extends approximately 0.55 inches beyond the elastomer portion 186. However, in certain embodiments, the reinforcement ring 168 may extend up to 3 inches or more beyond the elastomer portion 186, and in other embodiments, the reinforcement ring 168 may extend as little as 0.1 inches or less beyond the elastomer portion 186. The distance that the reinforcement ring 168 extends beyond the elastomer portion 186 may be selected in part based on characteristics of the geological formation 20 (e.g., unconsolidated, consolidated, or some variation there between) to provide a more secure seal. For example, for a more consolidated formation the reinforcement ring 168 may extend approximately 0.25 inches beyond the elastomer portion 186. In one example, the length of the distance that the reinforcement ring 168 extends beyond the elastomer portion 186 may be selected to be relatively greater (e.g., approximately 0.55 inches or beyond), for example, when the geological formation 20 is less consolidated and, therefore, more likely to collapse otherwise. The length of the distance that the reinforcement ring 168 extends beyond the elastomer portion 186 may be selected to be relatively smaller (e.g., approximately 0.25 inches or less), for example, when the geological formation 20 is more consolidated and, therefore, somewhat less likely to collapse otherwise. In general, the height of the reinforcement ring 168 may be limited by the support structures (e.g., a bumper 196) of a downhole tool (e.g., drill string 16, wireline downhole tool 100, etc.).

Figure 6:
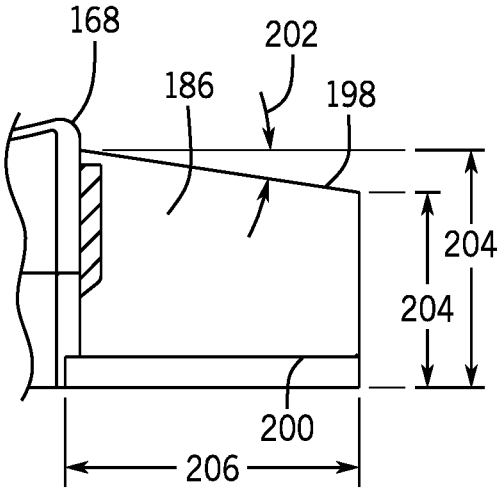
FIG. 6 is a cross-sectional view of another embodiment of the reinforcement ring and the elastomer of a multi-intake probe.

FIG. 6 is a cross-sectional view of an embodiment of the guard probe 138 with the reinforcement ring 168. In the illustrated embodiment, the elastomer portion 186 has a shape configured to form a strong seal in combination with the reinforcement ring 168 when pressed against the geological formation 20. Specifically, the elastomer portion 186 has tapered top surface 198 disposed opposite a base surface 200 of the elastomer portion 186. As such, the elastomer portion 186 includes a monotonically decreasing height 204 from the reinforcement ring 168. This may reduce an amount of fluid that could become trapped between the reinforcement ring 168 and the elastomer portion 186 when the guard probe 138 is pressed against the geological formation 20, and may also improve the stability of the u geological formation 20 during the sampling operation. An angle 202 at which the height 204 of the elastomer portion 186 monotonically decreases from the reinforcement ring 168 may be selected depending on the behavior of the guard probe 138 in different types of formations. For example, the angle 202 at which the height 204 of the elastomer portion 186 monotonically decreases from the reinforcement ring 168 may be selected to be relatively greater, for example, when the geological formation 20 is more consolidated, and may be selected to be relatively lesser, for example, when the geological formation 20 is less consolidated (or vice versa). Additionally or alternatively, the elastomer portion 186 may be substantially flat, but still lower than the reinforcement ring 168.

Moreover, the elastomer portion 186 may have any suitable radial width 206 beyond the reinforcement ring 168. In one embodiment, the width is at least double that of the radius of the interior of the guard probe 138 (within the reinforcement ring), but may extend to be much greater (e.g., up to an 8:1 ratio, or even more). The radial width 206 of the elastomer portion 186 may be selected depending on the characteristics of the geological formation 20. For example, the radial width 206 of the elastomer portion 186 may be selected to be relatively greater, for example, when the geological formation 20 is less consolidated, and may be selected to be relatively lesser, for example, when the geological formation 20 is more consolidated (or vice versa). In certain embodiments, an extension plate 208 may be used to support the extended width of the elastomer portion 186.

Figure 7:
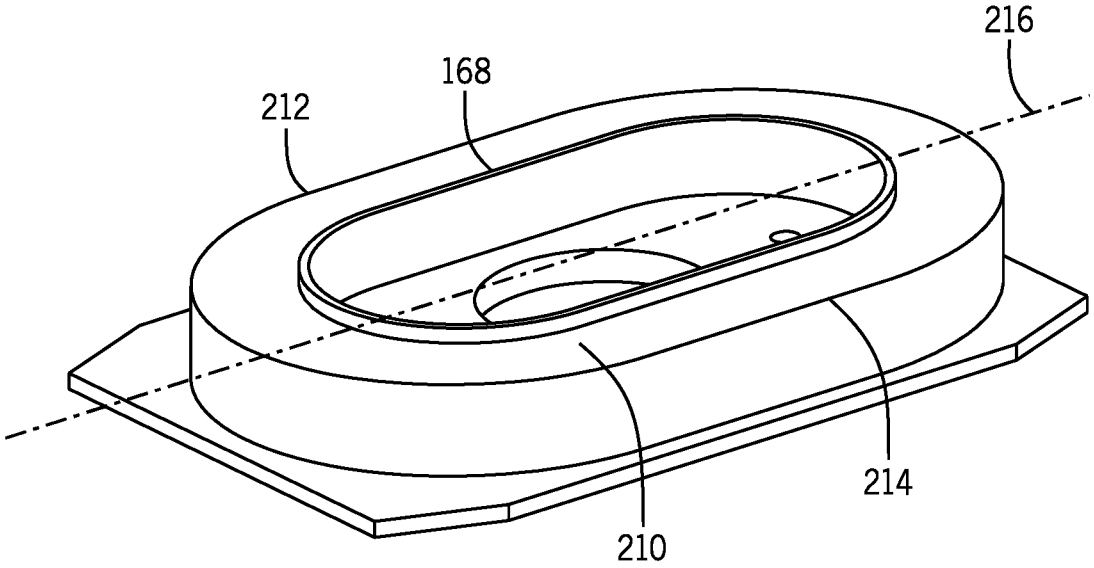
FIG. 7 is a perspective view of an embodiment of an elliptical reinforcement ring and an elliptical elastomer of a multi-intake probe.

The reinforcement ring 168 may be used in any other suitable fluid probes to enhance sampling in unconsolidated formations. For example, as shown in FIG. 7, which is a perspective view of an elliptical elastomer portion 210, a reinforcement ring 168 may be used to enhance formation support when the elliptical elastomer portion 210 is used for fluid sampling. The elliptical elastomer portion 210 may include an elliptical shape having a first flat edge 212 and a second flat edge 214, wherein the first flat edge 212 is disposed opposite to the second flat edge 214, and wherein the first flat edge 212 and the second flat edge 214 are disposed parallel to a semi-major axis 216 of the elliptical elastomer portion 210. Other types of elastomer portions 186 that may benefit from the reinforcement ring 168 to extend into the geological formation 20 to provide support during sampling may include, for example, large diameter, extra-large diameter, elliptical, large area, and long nose elastomer portion 186. Moreover, while this disclosure has referred to a reinforcement ring 168, it should be appreciated that any suitable material may be used to form the reinforcement ring 168 in addition to or alternatively to metal (e.g., ceramic, polycrystalline diamond compact, plastic).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A probe module system for sampling formation fluid from a geological formation, comprising:

a guard probe comprising an elastomer portion and a reinforcement ring, wherein the reinforcement ring is at least partially disposed within an elastomer borehole of the elastomer portion, the reinforcement ring extending beyond the elastomer portion, wherein the elastomer portion is configured to press against the geological formation to form a seal during a sampling operation, and wherein the reinforcement ring is configured to support the geological formation during the sampling operation, wherein a movable probe base is configured to radially extend the guard probe and the elastomer portion; and a sampling probe disposed within a borehole of the guard probe, wherein the sampling probe is surrounded by the reinforcement ring and the sampling probe moves relative to the reinforcement ring, wherein the sampling probe is configured to press against the geological formation, and to perform the sampling operation by collecting formation fluid from the geological formation at an interface between a free end of the sampling probe and the geological formation, wherein a stop sleeve is disposed within a cylinder of the movable probe base, and wherein the stop sleeve is configured to restrict actuation of a hollow piston body of the sampling probe by engaging a stop formed on the hollow piston body.

2. The system of claim 1, wherein the reinforcement ring is configured to extend, relative to the elastomer portion, into the geological formation while the elastomer portion presses against the surface of the geological formation.

3. The system of claim 2, wherein the reinforcement ring is configured to extend into the geological formation at least a distance that the reinforcement ring extends beyond the elastomer portion.

4. The system of claim 1, wherein the reinforcement ring comprises a stainless steel material.

5. The system of claim 1, wherein the elastomer portion comprises a tapered top surface disposed opposite a base surface of the elastomer portion.

6. The system of claim 1, wherein the elastomer portion comprises an elliptical shape comprising a first flat edge and a second flat edge, wherein the first flat edge is disposed opposite to the second flat edge, and wherein the first flat edge and the second flat edge are disposed parallel to a semi-major axis of the elliptical shape.

7. The system of claim 1, wherein the guard probe is configured to perform the sampling operation by collecting formation fluid from the geological formation.

8. The system of claim 7, wherein the borehole of the guard probe extends through the reinforcement ring, and wherein the guard probe is configured to perform the sampling operation by collecting formation fluid from the geological formation via a guard probe intake formed between the reinforcement ring and the sampling probe.

9. The system of claim 1, wherein the sampling probe and the reinforcement ring are coaxial.

10. A downhole fluid sampling system, comprising:

a probe module coupled to a downhole tool, wherein the probe module is configured to draw sample formation fluid from a geological formation, and wherein the probe module comprises:

a guard probe comprising an elastomer portion and a reinforcement ring coupled to a movable probe base of the probe module, wherein the reinforcement ring is at least partially disposed within an elastomer borehole of the elastomer portion, the reinforcement ring extending beyond the elastomer portion, wherein the elastomer portion is configured to press against the geological formation to form a seal during a sampling operation, and wherein the reinforcement ring is configured to support the geological formation during the sampling operation, wherein a movable probe base is configured to radially extend the guard probe and the elastomer portion; and a sampling probe disposed within a borehole of the guard probe, wherein the sampling probe is surrounded by the reinforcement ring and the sampling probe moves relative to the reinforcement ring, wherein the sampling probe is configured to press against the geological formation, and wherein the sampling probe is configured to perform the sampling operation by collecting formation fluid from the geological formation at an interface between a free end of the sampling probe and the geological formation, wherein a stop sleeve is disposed within a cylinder of the movable probe base, and wherein the stop sleeve is configured to restrict actuation of a hollow piston body of the sampling probe by engaging a stop formed on the hollow piston body; and a fluid sampling module coupled to the downhole tool and configured to evaluate fluid properties of the formation fluid from the geological formation.

11. The system of claim 10, wherein the geological formation is an unconsolidated geological formation, and wherein the reinforcement ring is configured to support the unconsolidated geological formation during the sampling operation to reduce a likelihood that the unconsolidated geological formation collapses during the sampling operation.

12. The system of claim 10, wherein the downhole tool comprises a drill string.

13. The system of claim 10, wherein the sampling probe comprises:

a hollow piston body configured to actuate within a cylinder of the movable probe base;

a sampling probe head configured to press against the geological formation during the sample operation; and a sample fluid line extending from the sampling probe head through the hollow piston body to a fluid sample module, wherein formation fluid collected during the sampling operation enters the sampling probe through the sampling probe head and travels through the sample fluid line to the fluid sample module.

14. The system of claim 10, wherein the probe module comprises a setting piston configured to extend into the geological formation to support the probe module, and wherein the setting piston is disposed on a side of a drilling tool opposite the sampling probe and the guard probe such that the setting piston extends toward the geological formation in a direction opposite of extension of the sampling probe and the guard probe against the geological formation.

15. The system of claim 10, wherein the stop sleeve is configured to restrict actuation of the hollow piston body of the sampling probe proximate an end stroke of the hollow piston body.

16. The system of claim 10, wherein the stop sleeve is configured to prevent the sampling probe from extending beyond an actuation threshold.

17. A method for collecting downhole formation fluid samples, comprising:

positioning a probe module at a sampling site for a sampling operation, wherein the probe module comprises:

a guard probe comprising an elastomer portion and a reinforcement ring coupled to a movable probe base of the probe module, wherein the reinforcement ring is at least partially disposed within an elastomer borehole of the elastomer portion, the reinforcement ring extending beyond the elastomer portion; and a sampling probe disposed within a borehole of the guard probe, wherein the sampling probe is surrounded by the reinforcement ring and the sampling probe moves relative to the reinforcement ring, wherein a stop sleeve is disposed within a cylinder of the movable probe base, and wherein the stop sleeve is configured to restrict actuation of a hollow piston body of the sampling probe by engaging a stop formed on the hollow piston body;

extending the movable probe base toward a geological formation such that the guard probe presses against the geological formation, wherein the reinforcement ring is configured to breach the geological formation and extend into the geological formation to support the geological formation during the sampling operation, and wherein the elastomer portion is configured to press against a surface of the geological formation to form a seal between the geological formation and the guard probe;

extending the sampling probe, with respect to the reinforcement ring, such that the sampling probe presses against the geological formation; and collecting formation fluid from the geological formation via a sampling probe intake of the sampling probe.

18. The method of claim 17, comprising stopping extension of the sampling probe at an actuation threshold located at a free end of the reinforcement ring.

19. The method of claim 17, comprising disengaging the probe module, wherein disengaging the probe module comprises:

retracting the sampling probe;

determining that the sampling probe is retracted into the borehole of the guard probe; and retracting the movable probe base to disengage the guard probe from the geological formation and retract the guard probe.

20. The system of claim 1, wherein the stop sleeve comprises a ring disposed about the hollow piston body of the sampling probe.

* * * * *